US009312615B2

(12) United States Patent
Kroeckel

(10) Patent No.: US 9,312,615 B2
(45) Date of Patent: Apr. 12, 2016

(54) CONTACT ELEMENT FOR DIRECTLY ELECTRICALLY CONTACTING CIRCUIT BOARDS

(75) Inventor: Markus Kroeckel, Schwieberdingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 219 days.

(21) Appl. No.: 14/114,731

(22) PCT Filed: Mar. 9, 2012

(86) PCT No.: PCT/EP2012/054076

§ 371 (c)(1),
(2), (4) Date: Feb. 4, 2014

(87) PCT Pub. No.: WO2012/146432

PCT Pub. Date: Nov. 1, 2012

(65) Prior Publication Data

US 2014/0302725 A1 Oct. 9, 2014

(30) Foreign Application Priority Data

Apr. 29, 2011 (DE) ..... 10 2011 017 787

(51) Int. Cl.

| | |
|---|---|
| ***H01R 13/187*** | (2006.01) |
| ***H01R 12/50*** | (2011.01) |
| ***H01R 12/72*** | (2011.01) |
| ***H01R 24/60*** | (2011.01) |

(Continued)

(52) U.S. Cl.

CPC ..... *H01R 12/50* (2013.01); *H01R 12/721* (2013.01); *H01R 24/60* (2013.01); *H01R 43/16* (2013.01); *H01R 13/642* (2013.01)

(58) Field of Classification Search

CPC ..... H01R 12/50; H01R 12/721; H01R 43/16; H01R 24/60

USPC ..... 439/876, 877, 850, 884–888, 878, 845, 439/846, 872, 832, 746.329

See application file for complete search history.

(56) References Cited

U.S. PATENT DOCUMENTS 2,854,648 A * 9/1958 Berg ..... 439/867
3,315,219 A 4/1967 Brinser et al.

(Continued)

FOREIGN PATENT DOCUMENTS

CN 1152808 A 6/1997
CN 1213521 C 8/2005

(Continued)

OTHER PUBLICATIONS

International Search Report for PCT/EP2012/054076, issued on May 31, 2012.

*Primary Examiner* — Abdullah Riyami
*Assistant Examiner* — Harshad Patel
(74) *Attorney, Agent, or Firm* — Kenyon & Kenyon LLP

(57) ABSTRACT

In a contact element for direct electrical contacting of a contact surface on a circuit board, a front insertion portion is constituted by a metal sheet having two multiple-ply lateral edges located opposite one another, and having a center portion located therebetween and having fewer plies, in particular one ply, the two lateral edges extending with their outer peripheral edges parallel to one another and each being turned over at least once; and at least one of the two outer lateral edges having a projecting contacting protrusion for direct electrical contacting of a contact surface.

20 Claims, 6 Drawing Sheets

(51) Int. Cl.
*H01R 43/16* (2006.01)
*H01R 13/642* (2006.01)

(56) References Cited

U.S. PATENT DOCUMENTS

| | | | | |
|---|---|---|---|---|
| 3,601,751 | A * | 8/1971 | Pauza | 439/630 |
| 3,742,432 | A | 6/1973 | Curtis et al. | |
| 6,685,514 | B2 * | 2/2004 | Costa | 439/876 |
| 7,331,831 | B2 | 2/2008 | Cvasa | |
| 8,360,812 | B2 * | 1/2013 | Osvatic et al. | 439/819 |
| 2004/0214480 | A1 * | 10/2004 | Kitajima | 439/876 |
| 2007/0105422 | A1 | 5/2007 | Cvasa | |

FOREIGN PATENT DOCUMENTS

| | | | |
|---|---|---|---|
| CN | 101404362 | A | 4/2009 |
| CN | 101673892 | A | 3/2010 |
| EP | 0467866 | | 1/1992 |
| EP | 1786067 | | 5/2007 |
| JP | 48017749 | | 5/1973 |
| JP | 53048984 | | 11/1978 |
| JP | 2004327380 | | 11/2004 |
| NL | 6508658 | | 1/1966 |

* cited by examiner

CONTACT ELEMENT FOR DIRECTLY ELECTRICALLY CONTACTING CIRCUIT BOARDS

FIELD OF THE INVENTION

The invention proceeds from a contact element for direct electrical contacting of a contact surface on a circuit board.

BACKGROUND INFORMATION

Control units are usually made up of a circuit board on which electronic components are placed, and a housing. In engine control units, a multipoint connector is usually installed on the circuit board in order to create the electrical connection between a wiring harness plug connector and the circuit board. The multipoint connector thus represents an additional component in the context of installation of the control unit.

Also known are direct electrical contacting systems, or so-called electrical "vias," in which the multipoint connector is omitted and the individual poles of the wiring harness are contacted directly on the circuit board. Electrical contact surfaces or "lands," which are contacted using contact elements that are inserted into the wiring harness plug connector, are provided for this purpose on the circuit board. The contact surfaces are usually contacted by projecting contact springs of the contact elements. The contact elements can be manufactured from a thin metal sheet using stamping and deformation technology. The risk exists in the context of the installation and handling of the contact elements, however, especially upon passage through a sealing mat, that the contact elements and in particular their projecting contact springs may be bent and thereby plastically deformed.

SUMMARY

The turnover (also called a "doubling" or "foldover") according to the present invention of the side edges of the contact element offers the following advantages as compared with the known contact elements:

- appreciable increase in the robustness of the contact element;
- reduced number of laborious stamping and bending processes;
- contact design is not multi-part but now only single-part;
- appreciable simplification of contact element structure;
- contact spring on contact element can be omitted;
- thinner sheet metal can be used;
- reduction in material use;
- sharp edges and projecting latching tips on the contact element are avoided, so that the contact element can be passed through a sealing mat without damaging it, i.e. contact element has improved sealing-mat compatibility;
- as a result of the small transverse dimension of the contact element, the grid spacing, i.e. the distance between adjacent contact elements in the contact carrier, can be reduced to approx. 1.0 mm.

DETAILED DESCRIPTION

Figure 1:
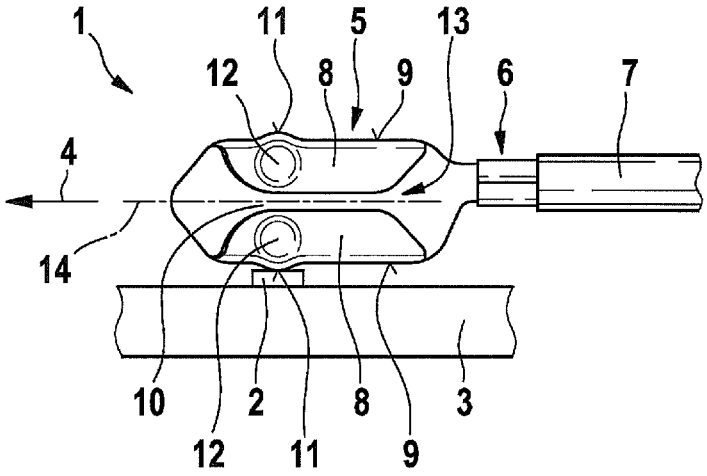
FIG. 1 is a side view of a first exemplifying embodiment of the contact element according to the present invention for direct electrical contacting of a circuit board, a contact carrier not being shown.

Contact element 1 shown in FIG. 1 serves for direct electrical contacting of a contact surface ("land") 2 on a circuit board 3, and is usually inserted into a contact carrier 20 (FIG. 2) in insertion direction 4.

Contact element 1 encompasses a front (in insertion direction 4) insertion portion 5 and a rear connector portion (e.g. crimp portion) 6 for connection of an electrical lead 7. Contact element 1 is constituted integrally by a metal sheet whose two mutually oppositely located lateral edges 8 in insertion portion 5 are each turned over or folded toward the same side, and extend with their outer peripheral edges 9 parallel to one another. Between the two double-ply lateral edges 8, insertion portion 5 has a single-ply center portion 10. For direct electrical contacting of a contact surface 2, a respective outwardly projecting contacting protrusion (or contact point) 11 is constituted at the two outer peripheral edges 9 by the fact that the turned-over lateral edge 8 is plastically deformed by a lateral impression 12 in the turned-over lateral edge 8. The two double-ply lateral edges 8 and the single-ply center portion 10 together constitute a laterally open guidance groove or coding groove 13 (FIG. 2) extending in insertion direction 4. In the exemplifying embodiment shown, coding groove 13 is disposed centeredly and insertion portion 5 is embodied mirror-symmetrically with reference to its longitudinal center plane 14. All edges of contact element 1 are preferably rounded off by embossing in order to avoid damage to a mat seal upon passage through the mat seal.

Figure 11:
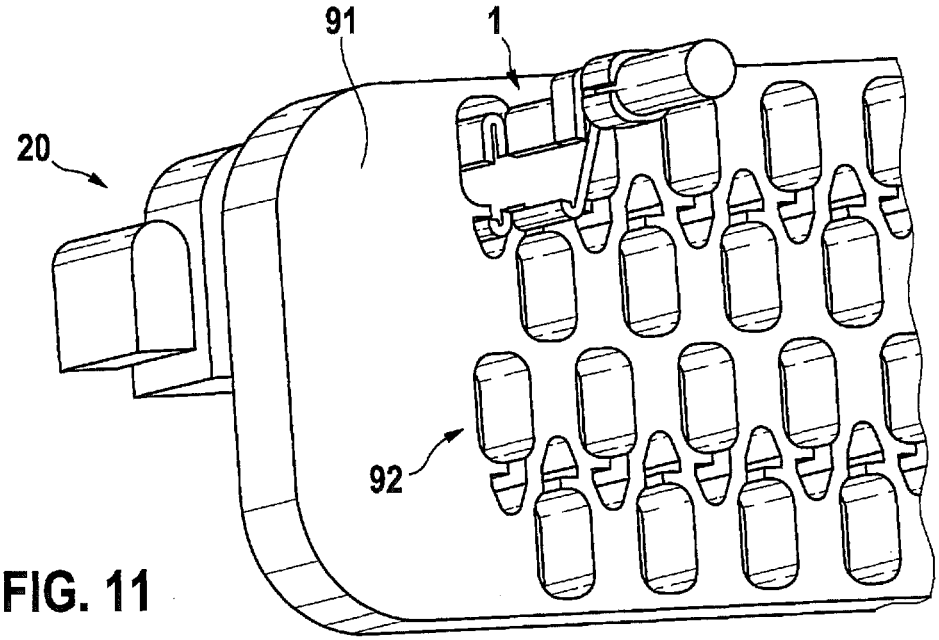
FIG. 11 shows a coding plate, disposed in front of the contact carrier, for the contact elements to be inserted into the contact carrier.

Electrical lead 7 can be abutted against connector portion 6 centeredly or eccentrically. In the latter case, in the context of a distance (grid spacing) of 1 mm from contact element 1 to contact element 1, the associated electrical leads 7 having a diameter of approx. 1 mm can be disposed in two planes and in this manner, as shown in FIG. 11, distributed onto two planes.

Figure 2:
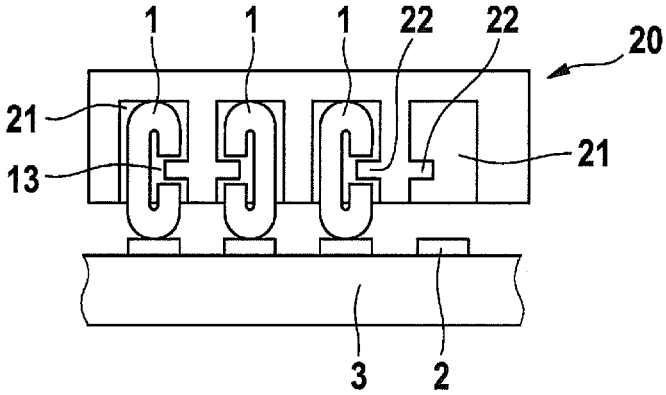
FIG. 2 is a sectioned depiction of a contact carrier having multiple contact elements of FIG. 1 according to the present invention inserted thereinto.

As shown in FIG. 2, multiple contact elements 1 are inserted into corresponding contact chambers 21 of contact carrier 20. Contact chambers 21 have guidance ribs 22, protruding alternately on the one or the other lateral chamber wall, that interact with coding grooves 13 of contact elements 1 so as thereby to orient contact elements 1 within contact chambers 21 in a manner selectably rotated 180 degrees. In the exemplifying embodiment of FIG. 2, contact elements 1 are each located mirror-symmetrically "back to back."

Figure 3A:
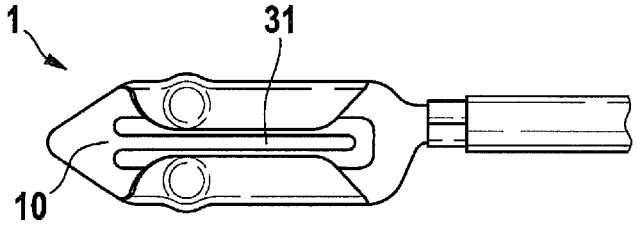
FIGS. 3*a*, 3*b* are two different side views of a second exemplifying embodiment of the contact element according to the present invention for direct electrical contacting of a circuit board.
Figure 3B:
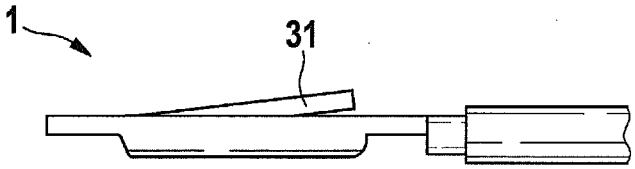
Figure 4:
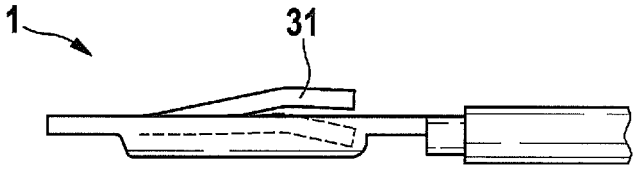
FIGS. 4, 5 are side views of two further exemplifying embodiments of the contact element according to the present invention for direct electrical contacting of a circuit board.
Figure 5:
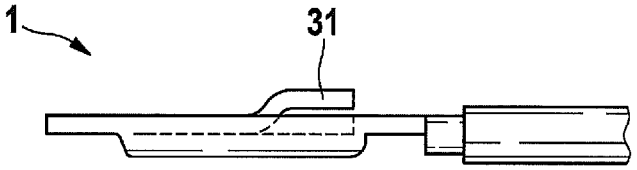

Contact elements 1 shown in FIGS. 3 to 5 differ from contact element 1 only in that here center portion 10 additionally has a housing tongue (latching tongue) 31, extending backward, that protrudes out of the plane of center portion 10 on the side located opposite the turned-over lateral edge 8.

Housing tongue 31 is straight in FIG. 3, bent once (cranked) in FIG. 4, and bent into an S-shape in FIG. 5. The backward-extending housing tongue 31 does not prevent contact element 1 from being inserted in insertion direction 4 through a sealing mat (not shown), but at most is deflected inward into the plane of center portion 10 while being inserted through, as indicated with a dashed line in FIG. 4. Housing tongue 31 constitutes a latching tip in order to latch contact element 1, inserted into contact carrier 20 in insertion direction 4, in the carrier oppositely to insertion direction 4. Alternatively, housing tongue 31 shown in FIG. 3 can also be omitted. Contact element 1 can then be latched by way of the remaining opening, via an element on the contact carrier.

Figure 6:
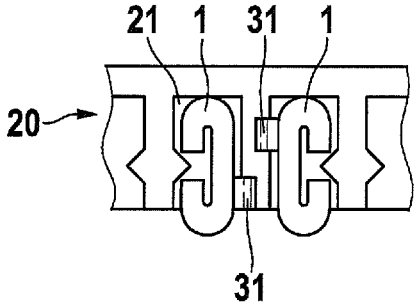
FIG. 6 is a sectioned depiction of a contact carrier having multiple contact elements of FIGS. 4 and 5 according to the present invention inserted thereinto.

In the case of contact element 1 shown in FIG. 6, housing tongue 31 is disposed eccentrically rather than centeredly as in FIGS. 3 to 5, so that here contact elements 1 are not located "back to back" as mirror images.

Figure 7A:
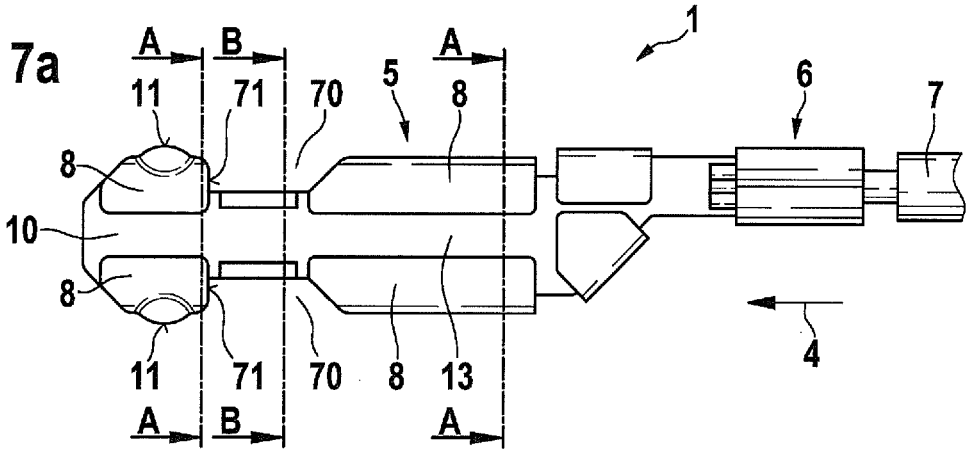
FIGS. 7*a* to 7*d* show further exemplifying embodiments of the contact element according to the present invention for direct electrical contacting of a circuit board, specifically a side view of a contact element having symmetrically turned-over side edges (FIG. 7*a*), a perspective view of a contact element having asymmetrically turned-over side edges (FIG. 7*b*), and perspective views of a contact element optimized in terms of production engineering and having asymmetrically turned-over side edges (FIGS. 7*c*, 7*d*).

Contact element 1 shown in FIG. 7*a* differs from the contact element of FIG. 1 in that here the turned-over lateral edges 8 each have a laterally open cutout 70 that, viewed in insertion direction 4, constitutes an undercut edge or an undercut 71, and divides the turned-over lateral edges 8 respectively into a front and a rear turned-over lateral edge portion. With the aid of undercut 71, contact elements 1 inserted into contact carrier 20 can be individually latched or collectively locked in place therein. Lateral edges 8 are turned over symmetrically, so that coding groove 13 extends centeredly.

Figure 7B:
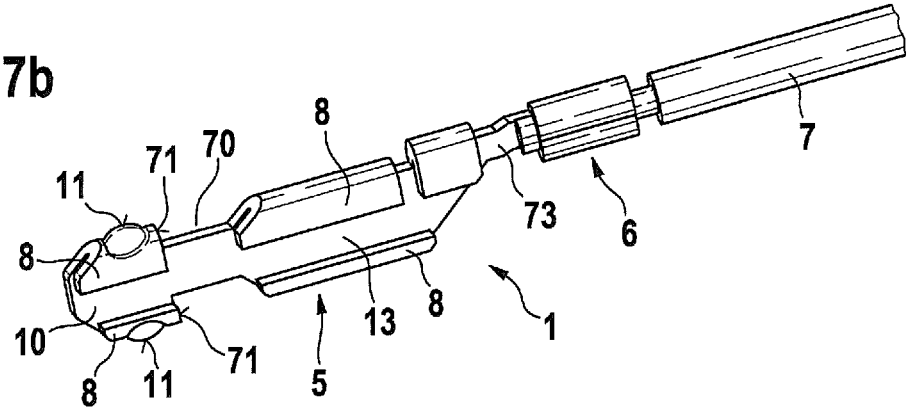

Contact element 1 shown in FIG. 7*b* differs from the contact element of FIG. 7*a* only in that here lateral edges 8 are turned over asymmetrically, and coding groove 13 consequently extends eccentrically.

Figure 7C:
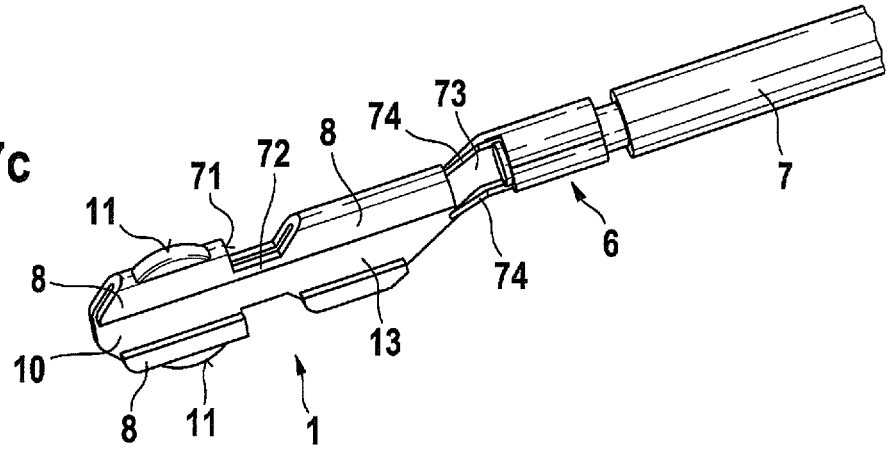
Figure 7D:
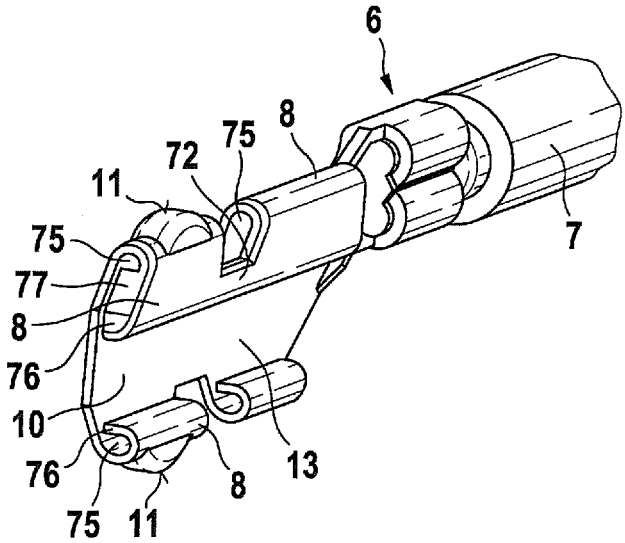

FIGS. 7*c*, 7*d* show a contact element 1 optimized in terms of production engineering as compared with FIG. 7*b*, in which element the front and the rear turned-over lateral edge portion are connected to one another by a web 72 in order to enhance the robustness of contact element 1 in terms of buckling. The turned-over lateral edges 8 and crimped portion 6 are offset in parallel fashion from one another via a connecting portion 73 located between them, lateral edges 74 of the connecting portion being folded over in order to enhance the robustness of connecting portion 73 in terms of buckling. Upper lateral edge 74 can also be connected to the turned-over upper lateral edge 8 for this purpose, as shown in FIG. 7*c*. In an embodiment with a thin sheet-metal thickness, as shown in FIG. 7*d*, lateral edges 8 are turned over so that a gap 75 remains between the turned-over lateral edges 8 and center portion 10. The turned-over lateral edges 8 abut with their inwardly curved-over peripheral edges 76 against center portion 10 in order to stabilize the turned-over lateral edges 8. In addition, gap 75 of the turned-over upper lateral edge 8 can be closed at the front end (in insertion direction 4) of contact element 1 by a curved-over portion 77 of the upper lateral edge 8, in order to prevent damage to the mat seal.

Figure 8A:
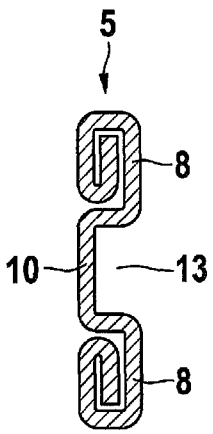
FIGS. 8*a* to 8*c* show various cross sections of an insertion portion of the contact element shown in FIG. 7, corresponding to section lines A-A and B-B in FIG. 7*a*.
Figure 8B:
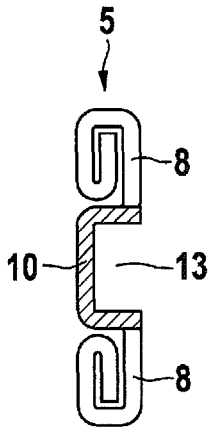
Figure 8C:
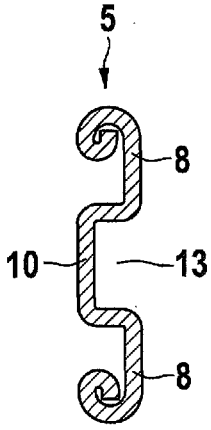

As shown in FIG. 8*a*, lateral edges 8 of contact element 1 shown in FIG. 7 are turned over inward several times, and in that context folded onto one another. As shown in FIG. 8*b*, center portion 10 has a U-shaped cross section in order to stiffen contact element 1 in particular in the region of cutout 70 and to configure coding groove 13. Instead of lying respectively in planar fashion on one another as in FIG. 8*a*, lateral edges 8 can also be turned over by being rolled in, as shown in FIG. 8*c*.

Figure 9A:
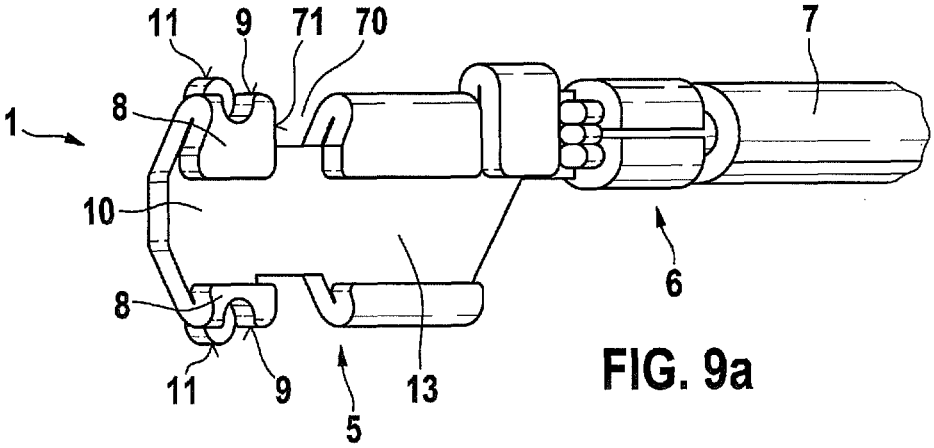
FIGS. 9*a*, 9*b* show yet another exemplifying embodiment of the contact element according to the present invention for direct electrical contacting of a circuit board, in a perspective view (FIG. 9*a*) and in a front view (FIG. 9*b*).
Figure 9B:
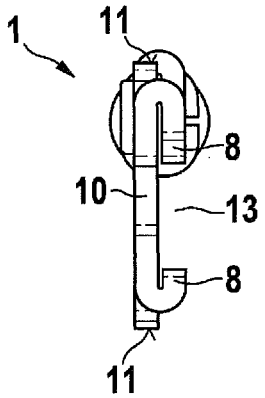
Figure 10:
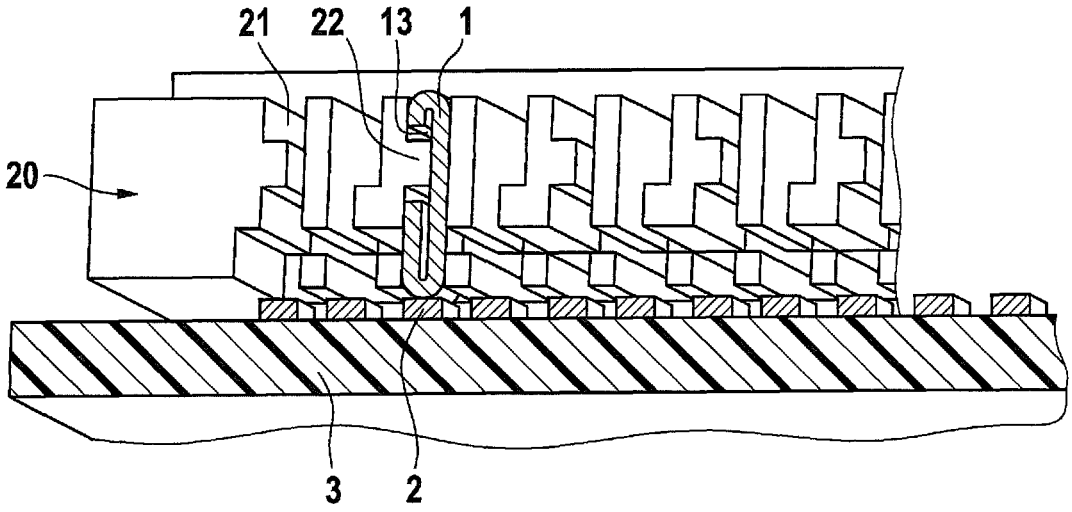
FIG. 10 is a front view of a contact carrier having a contact element of FIG. 9 according to the present invention inserted thereinto.

FIGS. 9*a*, 9*b* show a further contact element 1 that, like the contact elements shown in FIGS. 7*b* to 7*d*, has two lateral edges 8 turned over with different widths, i.e. asymmetrically, and an eccentric coding groove 13. As shown in FIG. 10, this eccentric coding groove 13, in coaction with guidance ribs 22 of contact chambers 21, makes it possible to insert contact element 1 into contact chamber 21 of contact carrier 20 in only a single orientation.

In FIG. 11, contact carrier 20 has disposed in front of it a coding plate 91 having coding cutouts 92 that, based on the eccentric coding groove 13, allow contact chambers 21 of contact carrier 20 to be respectively occupied only in one predetermined orientation of contact elements 1. The result is that the coding of contact elements 1 is possible already at coding plate 91 and thus already upon the introduction of contact elements 1 into the plug connection, i.e. before the contact elements are inserted through the mat seal and are located in contact carrier 20.

Figure 12A:
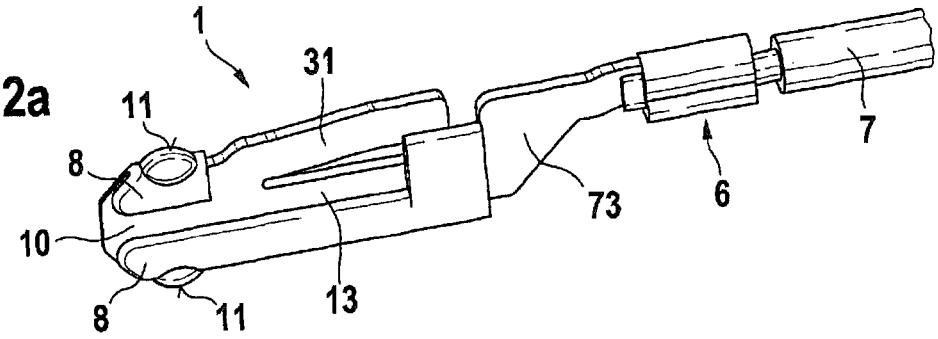
FIGS. 12*a* to 12*d* show a further exemplifying embodiment of the contact element according to the present invention, in a perspective view (FIG. 12*a*) and in a side view (FIG. 12*b*), as well as a rear view (FIG. 12*c*) and front view (FIG. 12*d*) of a contact carrier fitted with the contact element.
Figure 12B:
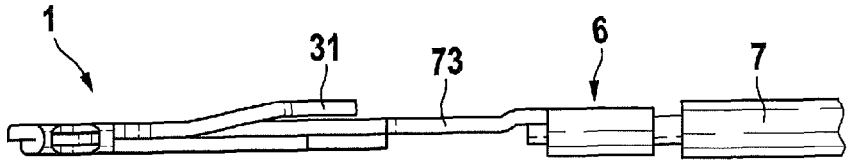

Contact element 1 shown in FIGS. 12*a*, 12*b* differs from the contact element of FIG. 4 only in that here the cranked latching tongue 31 is not disposed centeredly between the two turned-over lateral edges 8, but instead is disposed behind (in insertion direction 4) the upper turned-over lateral edge 8. Coding groove 13 can also be disposed eccentrically, instead of symmetrically as shown. As shown in FIG. 12*a*, the turned-over lower lateral edge 8 forms a stop for the inward deflection of latching tip 31. In contrast to what is shown in FIGS. 12*a*, 12*b* and by analogy with FIGS. 7*c*, 7*d*, the lateral edges of connecting portion 73 can also be folded over or turned over in order to enhance the robustness of contact element 1 in terms of buckling.

Figure 12C:
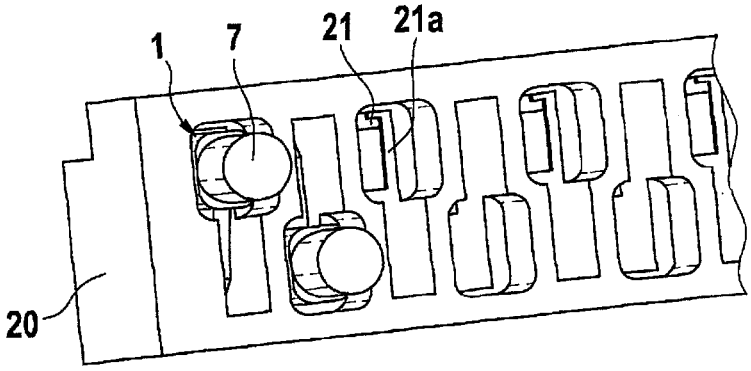
Figure 12D:
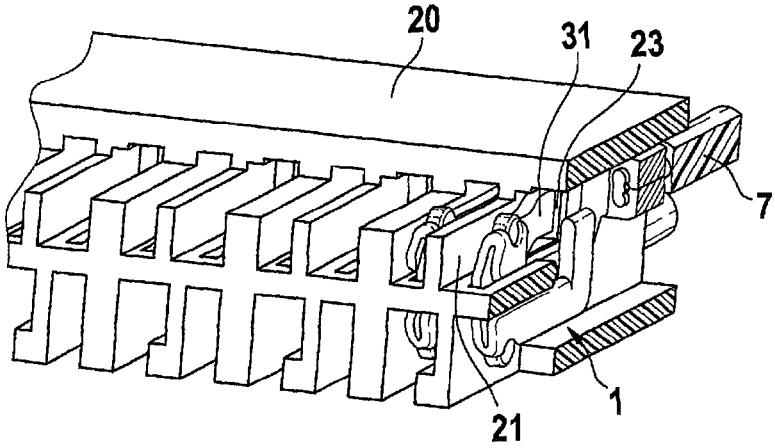

As shown in FIGS. 12*c*, 12*d*, upon introduction of contact element 1 into contact chamber 21 of contact housing 20, latching tongue 31 becomes deflected inward at a chamber wall 21*a* of contact chamber 21 until latching tongue 31 can engage behind an outwardly set-back abutment edge 23 of contact chamber 21. Alternatively, housing tongue 31 that is shown can also be omitted, so that what remains is an opening with which contact element 1 can be latched in contact carrier 20.

What is claimed is:

1. A contact element for a direct electrical contacting of a contact surface on a circuit board, comprising:

a front insertion portion from a perspective of an insertion direction, wherein the front insertion portion includes a metal sheet having two multiple-ply lateral edges located opposite one another; and a center portion located between the lateral edges, wherein:

the center portion includes a fewer number of plies than each of the two lateral edges, the two lateral edges extend with outer peripheral edges thereof parallel to one another and each lateral edge is turned over at least once, and at least one of the two lateral edges includes a projecting contacting protrusion for direct electrical contacting of the contact surface.

2. The contact element as recited in claim 1, wherein the center portion includes one ply.

3. The contact element as recited in claim 1, wherein the center portion includes a housing tongue, extending backward, that protrudes out of a plane of the center portion.

4. The contact element as recited in claim 3, wherein the housing tongue is one of disposed between the two lateral edges, and disposed behind one of the two lateral edges in the insertion direction.

5. The contact element as recited in claim 1, wherein the center portion and the lateral edges form a coding groove extending in the insertion direction and disposed one of centeredly and eccentrically.

6. The contact element as recited in claim 1, wherein the lateral edges, viewed in the insertion direction, each have an undercut.

7. The contact element as recited in claim 6, wherein the undercut is formed by a laterally open cutout in the respective lateral edge.

8. The contact element as recited in claim 7, wherein lateral edge portions, located on both sides of the open cutout, of the lateral edge are connected to one another by a connecting web of the turned-over lateral edge.

9. The contact element as recited in claim 1, wherein the center portion includes a U-shaped cross section.

10. The contact element as recited in claim 1, wherein the lateral edges are each turned over inward several times.

11. The contact element as recited in claim 1, wherein the lateral edges are each one of folded onto one another and rolled inward.

12. The contact element as recited in claim 1, wherein the turned-over lateral edges abut against the center portion one of in planar fashion, with a curved-over lateral edge, and with an inwardly curved-over lateral edge.

13. The contact element as recited in claim 1, wherein a gap present at a front end, from a perspective of the insertion direction of the contact element between the center portion and one of the lateral edges, is closed by a curved-over portion of the lateral edge.

14. The contact element as recited in claim 1, further comprising:

a connecting portion, provided between the lateral edges and a rear connector portion, having lateral edges that are folded over.

15. The contact element as recited in claim 14, wherein the lateral edges of the connecting portion are connected with one of the lateral edges of the center portion.

16. The contact element as recited in claim 1, further comprising:

a rear crimp portion, from a perspective in the insertion direction, disposed with an offset from a coding groove of the contact element.

17. A contact carrier, comprising:

a plurality of contact elements inserted in an insertion direction for direct electrical contacting of contact surfaces on a circuit board, wherein each contact element includes:

a front insertion portion from a perspective of an insertion direction, wherein the front insertion portion includes a metal sheet having two multiple-ply lateral edges located opposite one another; and a center portion located between the lateral edges, wherein:

the center portion includes a fewer number of plies than each of the two lateral edges, the two lateral edges extend with outer peripheral edges thereof parallel to one another and each lateral edge is turned over at least once, and at least one of the two lateral edges includes a projecting contacting protrusion for direct electrical contacting of the contact surface.

18. The contact carrier as recited in claim 17, further comprising:

a coding plate for the contact elements and disposed in front of the contact carrier.

19. The contact carrier as recited in claim 17, wherein adjacent contact elements are each rotated 180 degrees from one another.

20. The contact carrier as recited in claim 17, wherein rear crimp portions of adjacent contact elements are each disposed in different planes.

* * * * *